US008783076B2

(12) United States Patent
Schwenk et al.

(10) Patent No.: US 8,783,076 B2
(45) Date of Patent: Jul. 22, 2014

(54) LOCK-BOX

(75) Inventors: Manfred Schwenk, Vilbert (DE); Ulrich Bauer, Velbert (DE)

(73) Assignee: G. Schwepper Beschlag GmbH & Co. (DE)

( * ) Notice: Subject to any disclaimer, the term of this patent is extended or adjusted under 35 U.S.C. 154(b) by 387 days.

(21) Appl. No.: 13/146,182

(22) PCT Filed: Jan. 27, 2010

(86) PCT No.: PCT/EP2010/000501

§ 371 (c)(1),
(2), (4) Date: Mar. 12, 2012

(87) PCT Pub. No.: WO2010/086161

PCT Pub. Date: Aug. 5, 2010

(65) Prior Publication Data

US 2012/0167645 A1 Jul. 5, 2012

(30) Foreign Application Priority Data

Jan. 28, 2009 (DE) ..... 10 2009 006 352

(51) Int. Cl.

| | |
|---|---|
| ***E05B 49/00*** | (2006.01) |
| ***E05B 47/06*** | (2006.01) |
| ***E05B 63/16*** | (2006.01) |
| *E05B 47/00* | (2006.01) |

(52) U.S. Cl.

CPC ..... *E05B 47/0688* (2013.01); *E05B 63/16* (2013.01); *E05B 47/0012* (2013.01)

USPC ..... 70/278.7; 70/277; 70/279.1; 70/472

(58) Field of Classification Search

USPC ..... 70/277, 472, 283, 283.1, 218, 222, 70/279.1, 278.6, 278.7

See application file for complete search history.

(56) References Cited

U.S. PATENT DOCUMENTS

| | | | | |
|---|---|---|---|---|
| 4,148,092 | A * | 4/1979 | Martin | 361/172 |
| 4,433,355 | A * | 2/1984 | Chew et al. | 361/172 |
| 4,593,543 | A * | 6/1986 | Stefanek | 70/134 |
| 4,677,834 | A * | 7/1987 | Hicks | 70/279.1 |
| 4,820,330 | A * | 4/1989 | Lin | 70/277 |
| 5,640,863 | A * | 6/1997 | Frolov | 70/283 |
| 5,953,942 | A * | 9/1999 | Doucet et al. | 70/283 |
| 6,145,353 | A * | 11/2000 | Doucet | 70/277 |
| 6,286,347 | B1 * | 9/2001 | Frolov | 70/472 |
| 6,354,121 | B1 * | 3/2002 | Frolov | 70/277 |
| 6,363,762 | B1 * | 4/2002 | Kueng | 70/278.3 |

(Continued)

*Primary Examiner* — Suzanne Barrett

(74) *Attorney, Agent, or Firm* — Berliner & Associates

(57) ABSTRACT

A lock box for an electronic lock with lock box for an electromechanical lock comprising a housing with a first follower half that has a form-closed connection with a first handle for actuating the lock, with the first follower half having an actuating element for an unlocking linkage, a second follower half having a form-closed connection with a second handle for actuating the lock, restoring elements, a coupling element which in rest position (a) enables the first and the second follower half to move relative to one another and when in operating position (b) enables the two follower halves to be connected with one another, a motor, a control device as well as an energy supply, with the coupling element being provided with a pivotable articulated arm supported on the housing, said arm when in actuating position (b) engaging with recesses arranged in both follower halves so that when the second handle is actuated the lock can be opened via the second follower half.

15 Claims, 2 Drawing Sheets

(56) References Cited

Figure 3:
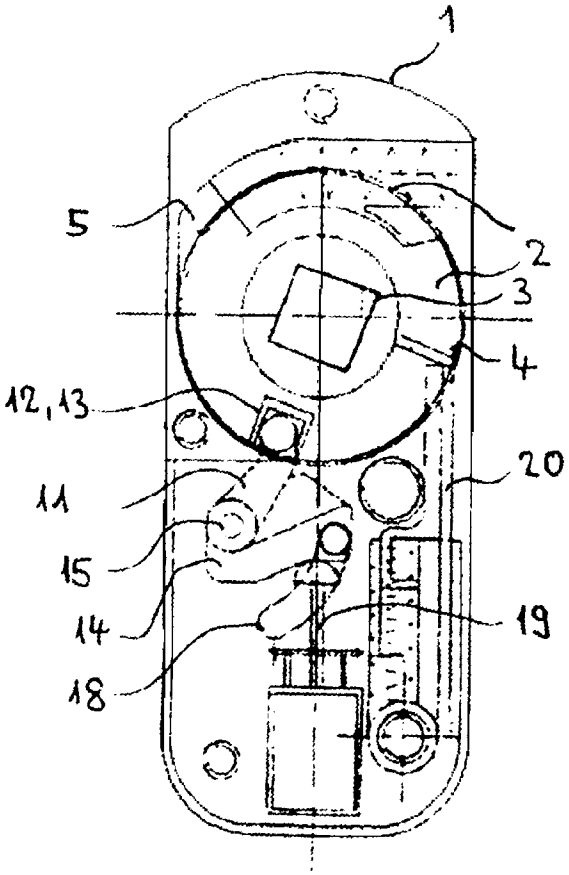

U.S. PATENT DOCUMENTS 6,640,594 B1 * 11/2003 Yao ..... 70/277
7,168,276 B2 * 1/2007 Errani et al. ..... 70/278.7
7,188,495 B2 * 3/2007 Errani et al. ..... 70/278.7
8,001,818 B2 * 8/2011 Imedio Ocana et al. ..... 70/472
8,555,685 B2 * 10/2013 Frolov et al. ..... 70/283

* cited by examiner (a)

(b)

LOCK-BOX

The invention relates to a lock box for an electronic lock with a housing, comprising a first follower half that has a form-closed connection with a first handle for actuating the lock, with the first follower half having an actuating element for an unlocking linkage, a second follower half having a form-closed connection with a second handle for actuating the lock, restoring elements to bring the follower halves in rest position after the actuation has been effected, a coupling element which when inactive enables the first and the second follower halves to move relative to one another and when in operating position enables the two follower halves to be connected with one another, a motor which when activated bringing the coupling element in operating position, a control device acting on the motor after relevant control signals are received as well as an energy supply.

Lock boxes are electro-mechanical devices for locking and latching purposes which are primarily but not exclusively used in lock systems, for example in administration buildings of industrial or trade undertakings, in hotels, cruise vessels etc. Lock boxes make it possible to open a lock with the aid of a code or electronic access authorization, i.e. without having to use a mechanical key. Especially reprogramming and also granting and revoking access authorizations can be brought about easily. A loss of an access authorization will not necessarily require that the lock has to be replaced.

As a rule, electromechanical locks of this type are designed such that they can only be opened from the outside via an access code while, from the inside, they can always be opened by means of the handle provided there—which is known as panic function. A widespread design principle employed to achieve such a different access capability is to divide the follower via which the handles act on the latching mechanism. The follower half acting on the inside of a door thus leads to the lock being mandatorily opened, i.e. this follower half is permanently connected with the unlocking linkage in a form-closed manner. On the other hand, the outer follower half is uncoupled, which means the outer handle has no function. From the outside the locking mechanism can exclusively be activated when access authorization is provided, for example by means of a magnetic-stripe card, punchcard, a transponder or via a code entered with the help of a keypad. When access authorization is provided an internal motor is activated such that the outer follower half is coupled to the inner follower half for a predetermined time span which allows the door to be opened. When this time span has expired the two follower halves and the outer handle are again deactivated.

Electromechanical locks of this nature are known, for example, from publication EP 1 662 076 A2. The coupling system described in that publication has been equipped with a split follower, the halves of which are freely movable relative to each other as long as a coupling lever arranged on the inner follower half does not engage with a recess provided in the outer follower half and causes the two follower halves to be functionally connected. The coupling action is effected by a motor which via a spring moves an actuating element and is activated by way of an access authorization. From the inside, the door can be opened permanently via the inner follower half whereas an actuation from the outside first requires that the motor is activated by means of access authorization means.

Another form of such an electromechanical lock has been disclosed by EP 1 522 659 A2, with said lock comprising two follower halves of the locking mechanism that are movable in relation to each other and being provided with a coupling element which is moved into the respective recesses in the follower halves with the help of a motor-driven threaded pin. The coupling element is arranged on a carriage capable of being moved in both directions by the threaded pin.

Disadvantage of the prior-art solutions is that the coupling mechanism is relatively complex, prone to failure and has high energy needs, the latter due to the fact that during the coupling action the motor must overcome the resistance caused by the spring element.

It is thus the objective of the invention to provide a lock box for an electromechanical lock equipped with a simple coupling mechanism, said mechanism when uncoupled having no connection with the actuating follower or a half of it, while in coupled state it reliably connects the two follower halves for the time span necessary to operate the lock.

This objective is achieved by providing a lock box of the kind first mentioned above being equipped with a coupling element provided with a pivotable articulated arm supported on the housing, said arm when in actuating position engaging with recesses arranged in both follower halves so that when the second handle is actuated the lock can be opened via the second follower half.

In the description that follows the terms first or inner follower half refer to the follower half that takes effect on the side of a door that does not require to be secured, usually the inner side of a (hotel) door, and via which the lock can be opened in any case. The terms second or outer follower half denote the follower half that takes effect on the side of the door that needs to be secured, as a rule the outer side of a (hotel) door, from where exclusively authorized persons shall be able to open the door.

According to the invention the lock box as a rule consists of a two-part housing arranged on the outer side of a door that requires to be secured. The locking mechanism is normally located at the lateral edge of the door and engages with the door frame via the usual latching means. Inside the housing a first follower half is arranged that is connected in a form-closed manner with a first handle, for example a knob or door handle via which the lock can be operated. The first follower half is provided with an actuating element by means of which the latching mechanism of the lock can be operated. Said actuating element may, for example, be a contact element for an unlocking linkage.

Also located in the housing is the second follower half which is connected in a form-closed way with a second handle for the operation of the lock. In uncoupled state the second follower half can freely move in relation to the first follower half. In this condition, the second follower half is functionless and moves freely when the external door handle or outer door knob is actuated.

Both follower halves are provided with customary restoring elements to bring the follower halves in rest position after actuation has been effected. Said restoring elements are as a rule customary spring elements suitably adapted to the design of the relevant follower half.

Otherwise and expediently, the two follower halves are mainly of mirror-inverted configuration. A separating disk is usually arranged between the two follower halves.

Also arranged inside the housing is a coupling element which in its rest position allows the first and second follower halves to be freely movable relative to each other and in its working or operating position causes the two follower halves to be connected with one another. The connection is brought about by a motor also arranged in the housing, said motor when activated causing the coupling element to be displaced or shifted into its operating position.

Another constituent of the inventive lock box is a control device acting on the motor after relevant control signals are received. The control signals may, for example, be entered via a keypad in the form of a numerical code, a transponder chip, a magnetic-stripe card, a punchcard or a chipcard. However, voice recognition systems capable of processing code words may also be employed.

To enable the lock box to operate a power supply is required which may, for example, be provided in the form of an integrated battery.

According to the invention the coupling element consists of a pivotable articulated arm supported on the housing, said arm when in actuated position engages with recesses arranged in the two follower halves so that when the second or outer handle is actuated the lock can be opened via the second or outer follower half. Actuation of the coupling element is effected by the motor having been activated via the control device. Generally, activation is in effect for a predetermined time span only but may also be enabled permanently, for example if renovation or constructional work is to be carried out. For this purpose, the control device can be programmed as desired.

The lock box provided according to the present invention allows programming the access authorization—for example a chipcard or magnetic-stripe card—such that the authorization period can be limited to an envisaged time span only during which lock actuation is enabled.

Motor, coupling element and the two follower halves of the inventive lock box are expediently arranged one below the other in such a manner that the motor shifts the coupling element upwards into the recesses provided in the follower halves causing the two follower halves to be connected to each other. After the lock has been enabled and the home or rest position of the follower halves restored the coupling element again takes up its rest position. To achieve this, a restoring spring or some other type of restoring mechanism is expediently provided, especially when the lock box is employed in ships where inclined positions and rolling movements may be encountered. For other applications the gravitational force may be used to enable the coupling element to be returned to its rest position.

Preferably, the coupling element is equipped with a pivotable articulated element having an articulated arm jointly supported via a pivotal point on the housing. The articulated element may be designed such that the articulated arm rests on a projection of the articulated element so that it can be moved by the motor together with the articulated element. However, thanks to the common pivotal point the articulated arm can be moved independently which is necessary if after the articulated arm has been engaged the pivot head is positioned inside the recesses of the two follower halves to enable the pivot head to be taken along when the turning movement of the follower halves takes place.

To improve the engaging action of the coupling element with the two follower halves the pivot head located at the free end of the articulated arm is expediently offset in the direction of the two follower halves. In principle, the pivot head is a pin which is long enough to engage simultaneously with the recesses provided in the two follower halves. Preferably, this pin is a round pin allowing movement to take place within the recesses of the follower halves and thus facilitating the travel of the articulated arm when the follower halves are actuated with the aid of the handle.

At its free end, i.e. the end located opposite the pivotal point, the articulated element is preferably provided with a guide pin moving within a guiding element. Such guiding element may, for example, be a gate or a slotted hole describing part of a circular arc around said pivotal point. The distance to the pivotal point corresponds to the distance between guide pin and pivotal point.

For the purpose of actuating the coupling element the motor is expediently provided with a spindle acting on the articulated element when activated and moving said element from resting into operating position. To achieve this, the spindle may have a broadened head conducive to constituting a large contact face acting on the underside of the articulated element. The underside of the articulated element is the side which is located opposite to the articulated arm.

The follower halves are provided with the customary restoring elements, for example spring elements. Said restoring element for the first follower half is expediently a spring element in the form of a helical spring mounted into the unlocking linkage. As restoring element for the second follower half a helical spring is recommendable, said spring being arranged in a spring casing and supported on the housing of the lock box. The second follower half is provided with a suitable contact element for this second restoring element.

Otherwise, the lock box according to the invention is provided with customary electronic and mechanical components which are known per se and to be used for reading and/or recognizing the respective access authorizations.

Figure 1:
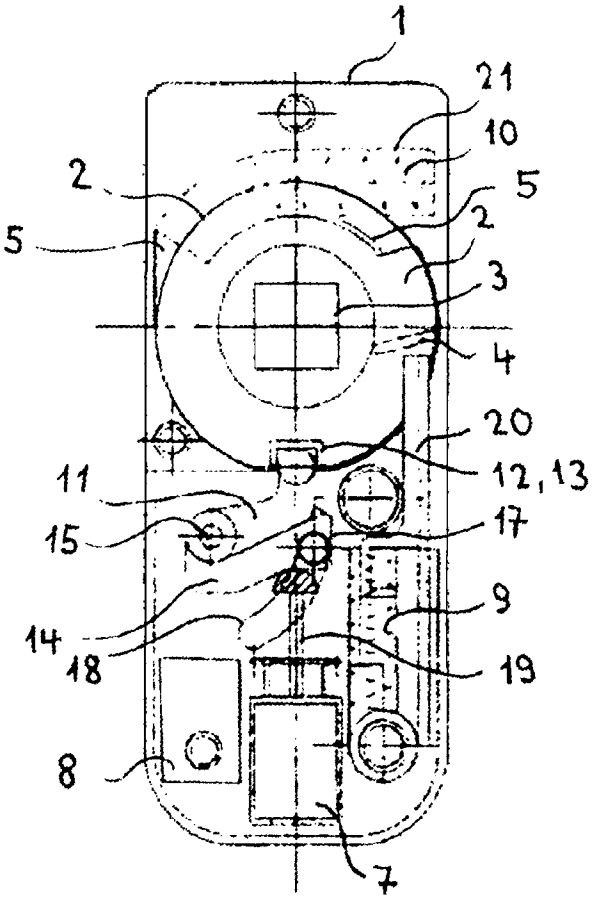
Figure 2:
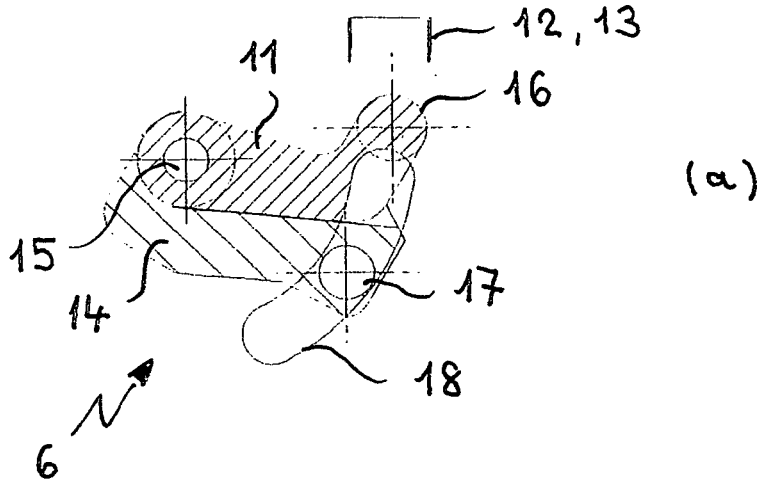
Figure 2:
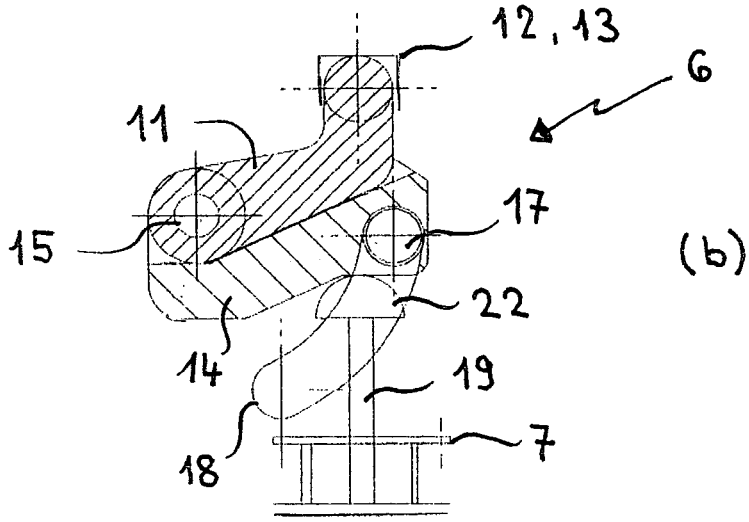

The invention is explained in more detail by way of the enclosed figures depicting a preferred embodiment, where FIG. 1 shows an inventive lock box in open state as viewed from the inside;

FIG. 2 illustrates a coupling element in rest position (a) and in operating position (b); and FIG. 3 shows a lock box according to the invention as per FIG. 1, with engaged coupling element during opening.

FIG. 1 is a top view of an inventive lock box as seen from the inside (door side). Inside housing 1 which as a rule is of two-part design (housing and cover) and screwed onto a door leaf at a height where the lock is arranged there is the first or inner follower half 2 with centrally arranged spindle for handle 3. An actuating element 4 in the form of a crossbar extends across the disk-shaped surface of follower half 2 and serves to push down unlocking linkage 20 when the spindle, respectively handle 3 is actuated.

The first follower half 2 conceals the second or outer follower half 5 to a major extent, said second half being attached to a spindle or handle supported on the same pivotal point via which the lock can be actuated.

A coupling element 6 (see FIG. 2) with articulated element 14 and an articulated arm 11 is arranged below the two follower halves 2, 5 and engages with recesses 12, 13 of the follower halves. The coupling element 6 is supported on housing 1 via pivotal point 15 around which said element is rotatable. A guide 18 in conjunction with a guide pin 17 permits the coupling element to rotate around the pivotal point 15 and thus either engages with the follower halves 2, 5 or disconnects from the follower halves 2,5 depending on the operating status of motor 7 which is arranged below the coupling element 6.

The motor 7 is provided with a spindle 19 that can be extended out of or retracted into the motor by a defined length. Spindle 19 has a spindle head 22 (FIG. 2(*b*)) acting against the underside of articulated element 14 and thus displacing said element which is guided in slotted hole 18 towards the follower halves 2, 5.

Moreover, the inventive lock box is also provided with a circuit board 8 expediently arranged close to the motor 7, said board being of a design suitable for processing the signals from a reading/receiving unit and then appropriately controlling the motor. In addition, feeder lines for the control of and power supply to the motor and circuit board are provided as well as batteries for the power supply in the event the lock box is not hooked up to the mains.

Unlocking linkage 20 acts in a manner known per se on one or several latches arranged in the door leaf, said latches serving to lock the door leaf in the door frame. A restoring spring 9 located in the unlocking linkage 20 causes the inner follower half 2 to return into its rest position after the lock has been actuated. A spring 10 suitably supported in a spring casing 21 enables the outer follower half 5 to be restored to its rest position after the lock has been actuated or the door handle operated in free-wheeling mode.

FIG. 2 shows the coupling element as per FIG. 1 in rest position (a) and in operating position (b). FIG. 2 (*a*) shows the coupling element in rest position (a). The element 6 consists of two parts, the articulated part 14 and the articulated arm 11. Both components are supported via pivotal point 15 and secured to the housing 1 by means of said pivotal point 15. At its free end the articulated part 14 is also provided with a guide pin 17 which travels and is guided in slotted hole 18 extending along part of a circular arc around pivotal point 15.

Articulated arm 11 is provided at its free end with pivot head 16 which is offset in the direction of the follower halves. The arm 11 rests on a projection of the articulated part 14 and is designed so as to be movable relative to articulated part 14 around pivotal point 15. Follower halves 2, 5 which are arranged above the coupling element 6 are illustrated in the form of the recesses 12, 13. In the illustration shown the follower halves 2, 5 are in uncoupled state.

FIG. 2 *b*) shows the follower halves in engaged or coupled state with the coupling element 6 moved upwards, said element being engaged in the recesses 12, 13 of the follower halves 2, 5 via articulated arm 11 and pivot head 16. In the Figure below the articulated part 14 spindle head 22 can be seen which has been moved out of motor 7 via the spindle 19 acting against the coupling element 6. In the configuration (b) shown the two follower halves 2 and 5 are joined together, however the lock has not yet been opened.

FIG. 3 shows the lock box as per FIG. 1 in activated state, i.e. with spindle 19 moved against the follower halves 2, 5, said spindle causing the articulated element 14 to assume its operating position (b), and articulated arm 11 engaged in the recesses 12, 13 of the follower halves 2, 5, said arm being displaced due to the turning movement of the follower halves 2, 5. After the lock has been opened and follower halves 2, 5 have been returned to rest position the articulated arm 11 is released and together with articulated part 14 again brought into rest position (a) by means of a restoring spring not shown in the illustration.

It is to be understood that the recesses 12, 13 and pivot head 16 have to be sized and matched to each other such that the turning movement of follower halves 2, 5 is not interfered with.

The invention claimed is:

1. Lock box for an electro-mechanical lock with a housing (1)

comprising a first follower half (2) that has a form-closed connection with a first handle for actuating the lock, with the first follower half (2) having an actuating element for an unlocking linkage (20), a second follower half (5) which is connected in a form-closed way with a second handle for the operation of the lock, restoring elements (9, 10) to bring the follower halves (2, 5) in rest position after actuation has been effected, a coupling element (6) which in its rest position (a) allows the first (2) and second follower half (5) to be freely movable relative to each other and in its working or operating position (b) causes the two follower halves (2, 5) to be connected with one another, a motor (7) which when activated brings the coupling element (6) in operating position (b), a control device (8) acting on the motor (7) after relevant control signals are received as well as an energy supply, characterized in that the coupling element (6) is provided with a pivotable articulated arm (11) supported on the housing (1), said arm when in actuating position (b) engaging with recesses (12, 13) arranged in both follower halves (2, 5) so that when the second handle is actuated the lock can be opened via the second follower half (5).

2. Lock box according to claim 1, characterized in that the coupling element (6) comprises a pivotable articulated element (14) having an articulated arm (11) jointly supported via a pivotal point (15) on the housing (1).

3. Lock box according to claim 2, characterized in that the articulated element (14) and the articulated arm (11) are supported so as to be pivotable relative to each other.

4. Lock box according to claim 1, characterized in that the articulated arm (11) is provided at its free end with a pivot head (16) which when in operating position (b) engages with the recesses (12, 13) arranged in the two follower halves (2, 5).

5. Lock box according to claim 4, characterized in that the pivot head (16) is offset in the direction of the follower halves (12, 13).

6. Lock box according to claim 2, characterized in that the articulated element (14) is provided at its free end with a guide pin (17) moving within a guiding element (18).

7. Lock box according to claim 6, characterized in that the guiding element (18) is a guide gate or a slotted hole.

8. Lock box according to claim 6, characterized in that the articulated arm (11) rests on the articulated element (14) and together with said element is moved from the resting position (a) into operating position (b).

9. Lock box according to claim 1, characterized in that the motor (7) is provided with a spindle (19) that when activated acts again the articulated element (14) thus moving said element from resting (a) into operating position (b).

10. Lock box according to claim 9, characterized in that after a defined time span the motor (7) moves the spindle (19) into its rest position.

11. Lock box according to claim 1, characterized in that the motor can be activated by means of a keypad, a magnetic-stripe card, a chipcard or a transponder.

12. Lock box according to claim 1, characterized in that the restoring element (9) for the first follower half (2) is a spring element arranged on the unlocking linkage (20).

13. Lock box according to claim 1, characterized in that the restoring element (10) for the second follower half (5) is a helical spring arranged in a spring casing (21) and supported on the housing (1).

14. Lock box according to claim 1 provided with one or several latches acting against the door leaf, said latches being moved via the unlocking linkage (20).

15. Lock with a lock box according to claim 1.

* * * * *